US007244221B2

(12) United States Patent
Alexander et al.

(10) Patent No.: US 7,244,221 B2
(45) Date of Patent: Jul. 17, 2007

(54) METHOD AND APPARATUS FOR SIMULTANEOUSLY FORMING AN ARTICULABLE CONTAINER WITH FOLD CREASES

(75) Inventors: Garold W. Alexander, Lewis Center, OH (US); Benjamin K. Hoblet, Powell, OH (US); Michael R. Fought, Columbus, OH (US); Jeffrey C. Reasinger, Hilliard, OH (US)

(73) Assignee: Rogar Capital Corporation, Lewis Center, OH (US)

( * ) Notice: Subject to any disclaimer, the term of this patent is extended or adjusted under 35 U.S.C. 154(b) by 439 days.

(21) Appl. No.: 10/850,791

(22) Filed: May 21, 2004

(65) Prior Publication Data

US 2005/0261116 A1 Nov. 24, 2005

(51) Int. Cl.
*B31B 1/44* (2006.01)

(52) U.S. Cl. ..... 493/167; 493/169; 493/170; 53/122; 53/561

(58) Field of Classification Search ..... 53/122, 53/561; 473/167, 169, 170
See application file for complete search history.

(56) References Cited

U.S. PATENT DOCUMENTS

| | | | | |
|---|---|---|---|---|
| 3,526,566 | A | 9/1970 | McIlvain, Jr. et al. | |
| 4,256,025 | A | 3/1981 | Goda et al. | |
| 4,348,449 | A | 9/1982 | Seufert | |
| 4,373,929 | A | 2/1983 | Smith | |
| 4,386,926 | A | 6/1983 | Heller | |
| 4,637,811 | A | 1/1987 | Fortney | |
| 4,778,439 | A | 10/1988 | Alexander | |
| 4,832,675 | A | 5/1989 | Stearns et al. | |
| 4,832,676 | A | 5/1989 | Johns et al. | |
| 5,073,162 | A * | 12/1991 | Campbell et al. | 493/396 |
| 5,205,476 | A | 4/1993 | Sorenson | |
| 5,221,249 | A | 6/1993 | Simpson | |
| 5,447,270 | A | 9/1995 | McNown | |
| 5,480,605 | A * | 1/1996 | Skaalen et al. | 264/234 |
| 5,509,885 | A | 4/1996 | Brunlid | |
| 5,577,989 | A | 11/1996 | Neary | |
| 5,888,183 | A | 3/1999 | Ruthenberg et al. | |
| 5,904,643 | A | 5/1999 | Seeberger et al. | |
| 6,162,155 | A | 12/2000 | Gordon et al. | |
| 6,282,870 | B1 * | 9/2001 | Robache | 53/453 |
| 6,415,944 | B1 | 7/2002 | Toussant | |
| 6,527,687 | B1 * | 3/2003 | Fortney et al. | 493/56 |

* cited by examiner

*Primary Examiner*—Christopher Harmon
(74) *Attorney, Agent, or Firm*—Frank H. Foster; Kremblas, Foster, Phillips & Pollick

(57) ABSTRACT

An apparatus for pressforming a paperboard sheet into an articulable pressformed container. The apparatus includes a pair of male and female, matingly engagable dies, which have interfacing forming surfaces in the shape of a container for engaging a paperboard sheet. A first one of the dies has a plurality of ridges extending from the forming surface and a second one of the dies has a plurality of grooves within the forming surface. The grooves register with the ridges when the dies matingly engage for creating creases in the paperboard sheet. The invention also includes a method for simultaneously shaping the container and forming fold creases on the container thereby making the container articulable.

5 Claims, 4 Drawing Sheets

METHOD AND APPARATUS FOR SIMULTANEOUSLY FORMING AN ARTICULABLE CONTAINER WITH FOLD CREASES

BACKGROUND OF THE INVENTION

1. Field of the Invention

This invention relates generally to pressforming a container, and more specifically to the method and apparatus used to manufacture an articulable clamshell container from a paperboard material.

2. Description of the Related Art

Clamshell containers, particularly those made from paperboard or corrugated materials, have long been known and used for packaging of various foods such as hamburgers, carry out meals, sandwiches, etc. They are desirable because they are a single piece structure which can be latched closed to enclose a food product and separate it from other contained food products in a sack or other wrap. Clamshell containers maintain the temperature and cleanliness of the food product and prevent the enclosed food product from contacting and possibly staining surrounding objects.

One type of clamshell containers is traditionally made from flat blanks that must be cut, creased (scored), and eventually folded and glued or interlocked into shape. However, these require many steps in their manufacturing process, making the process inefficient and costly and they provide a clamshell container which is not aesthetically pleasing, has openings which allow leakage and is subject to the disengagement of its interlocking parts. Such a clamshell container is shown in U.S. Pat. No. 5,205,476 to Sorenson.

Another known method of manufacturing a clamshell container involves a two-step process of first scoring the paperboard and then pressforming the paperboard into the container shape by the application of pressure and heat. Clamshell containers of this type are illustrated in U.S. Pat. No. 5,577,989 to Neary, U.S. Pat. No. 4,778,439 to Alexander, and U.S. Pat. No. 6,415,944 to Toussant.

The first step of scoring or creating a score line in the flat paperboard creates weakened lines or creases in the paperboard so that the material will fold in the preselected locations. A scoring tool, separate from the pressforming machine, has traditionally made the score lines when the sheet material is flat and before pressforming. Scoring tools are typically called "Diecutters", "Cutter/Creasers", or "Diecutting Machines The second step of pressforming or thermoforming the paperboard material in a die, forms the three dimensional contours of the clamshell container. Traditionally, the paperboard material is compressed between mating male and female dies of a die press. The deformation of the material is retained when the dies are withdrawn from the blank, so that the container retains its shape. This process forms a container having a continuous bottom and top portion, each of which have no openings around their sidewalls There are, however, some problems associated with the traditional manufacturing process. One problem arises because the workpiece of corrugated paperboard must be moved from the scoring tool to the die press. This presents a registration problem when inserting the scored paperboard sheet into the die press forming machine. It is imperative to bring the scored paperboard sheet into registration with the press forming dies so that the contour shaped by the dies is in proper alignment with the scores of the paperboard sheet. Should the scored paperboard sheet be out of registration with the dies, even by a small amount, the resulting container will have the scored lines in the wrong place with respect to the contour of the container so the container will not fold properly and therefore the two halves of the clamshell container will not meet in proper registration.

In addition, the conventional method of scoring the paperboard material prior to the pressforming process is deficient when drawing the material into shapes with steep sidewall angles, those deeper than a standard paper plate. As the material draws into the mold, the pre-scored lines intended to become the lines of weakness, about which the container will be folded to make a clamshell, can be smoothed out or disappear under the forming pressure, which reduces the relative weakness of the score line relative to the neighboring material. As a result, the fold lines are deformed making it difficult to fold the container along the original pre-scored fold lines.

Two U.S. Patents attempt to reduce the difficulties associated with manufacturing this type of container, U.S. Pat. No. 4,256,025 to Goda et al. and U.S. Pat. No. 5,904,643 to Seeberger et al. Goda discloses an apparatus for pressforming a hinged container requiring multiple steps for forming the container. Seeberger describes an apparatus for forming containers, in which the paper is first scored to define the shape of the container and thereafter, the scored stock is simultaneously cut and formed into a container. Neither of the processes described in these patents overcome the problems discussed above, including the problem of flattening the score lines during pressforming.

Therefore, it is an object and feature of the invention to provide an apparatus and a method for simultaneously forming creases in the paperboard while the paperboard is undergoing the pressforming process.

It is another object and feature of the invention to provide a method that reduces the inefficiency and reduces the cost of manufacturing a clamshell container.

BRIEF SUMMARY OF THE INVENTION

The invention is an apparatus for pressforming a paperboard sheet into an articulable pressformed container. The apparatus includes a pair of male and female, matingly engagable dies, which have interfacing forming surfaces in the shape of the container for engaging a paperboard sheet. A first one of the dies has a plurality of ridges extending from the forming surface and a second one of the dies has a plurality of grooves within the forming surface. The grooves register with the ridges when the dies matingly engage for creating creases in the paperboard sheet.

The invention also includes a method for simultaneously shaping the container and forming fold creases on the container.

Figure 1:
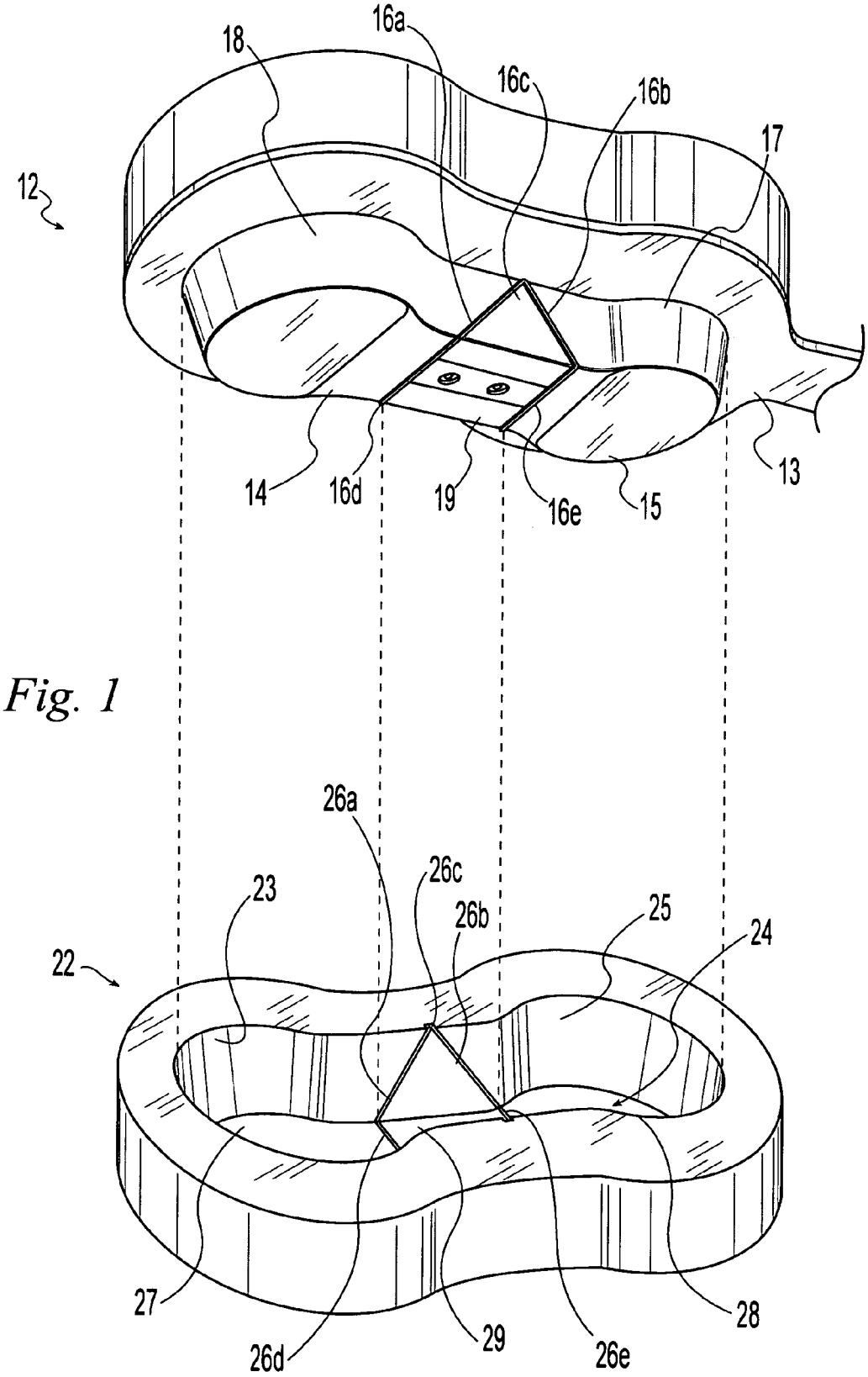
FIG. 1 is a view in perspective illustrating the preferred embodiment of the present invention.

In describing the preferred embodiment of the invention, which is illustrated in the drawings, specific terminology will be resorted to for the sake of clarity. However, it is not intended that the invention be limited to the specific term so selected and it is to be understood that each specific term includes all technical equivalents, which operate in a similar manner to accomplish a similar purpose.

DETAILED DESCRIPTION OF THE INVENTION

The preferred embodiment of the present invention is illustrated in FIG. 1. The invention is an apparatus 10 for pressforming a paperboard sheet into an articulable press-formed container. The apparatus 10 has matingly engageable, male 12 and female 22 dies. Each of the dies 12 and 22 have an interfacing forming surface 14 and 24 respectively, in the shape of a container for engaging a paperboard sheet interposed between the dies.

In the preferred embodiment, the forming surfaces 14 and 24 of the male and female dies 12 and 22 each have two rounded lobes 17, 18, 27 and 28 with a central narrower segment 19 and 29 connecting the two lobes. These form the sidewalls, top and bottom of the clamshell container illustrated in FIG. 5. The male die 12 is the punch, while the female die 22 has a cavity for accepting the punch during operation with the paperboard sheet interposed between them. In the preferred embodiment, both the male 12 and female 22 dies are made from steel. However, as will be recognized by a person having ordinary skill in the art, the dies can be made from a variety of suitable materials including plastic or aluminum.

In the preferred embodiment, a first one of the dies has a plurality of ridges 16 extending from the forming surface 14, and a second one of the dies has a plurality of grooves 26 within the forming surface 24 of the die. The ridges 16 are preferably segments of steel inserted into pre-cut slots of the forming surface. Alternatively, the ridges 16 can also be machined into the steel of the die wherein the die material is shaped to extend out to form the ridges. The ridges 16 can also be welded onto the forming surface of the die, though subsequent machining may be required.

Preferably, the ridges 16 extend from the forming surface 14 of the male die 12 and the grooves 26 are within the forming surface 24 of the female die 22. However, a person having ordinary skill in the art will recognize that the ridges 16 can extend from the forming surface of the female die 22 and the grooves 26 can be within the forming surface of the male die 12. This distinction is dependent upon the desired direction of the fold crease developed in the paperboard sheet 11.

Figure 5:
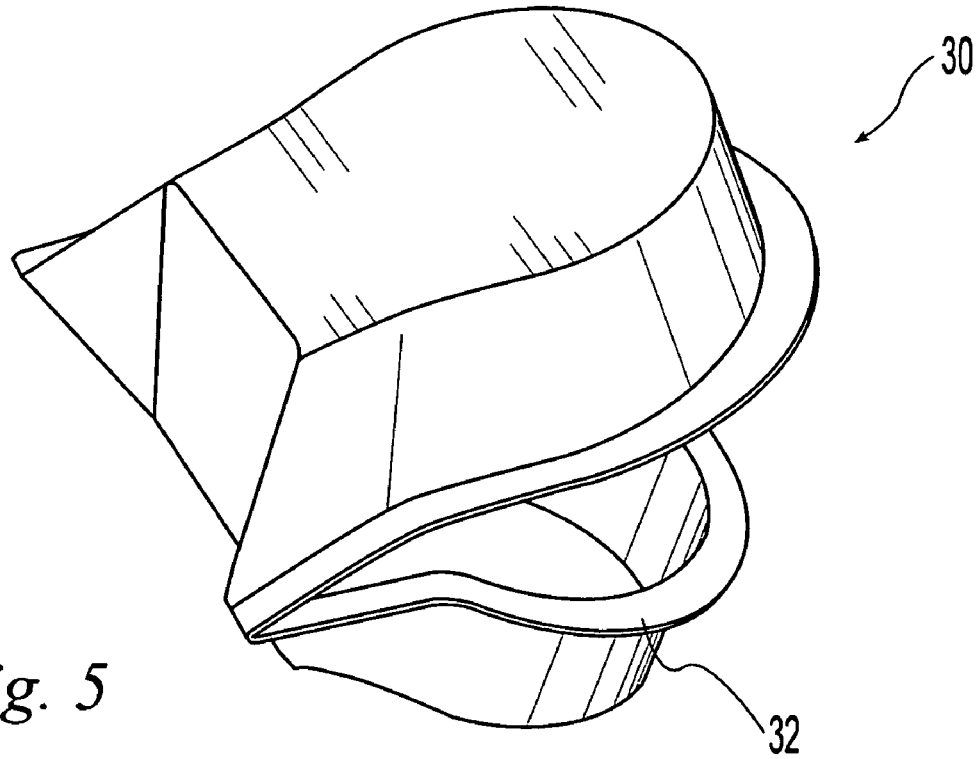
FIG. 5 is a view in perspective illustrating a clamshell container manufactured in accordance with the invention.

In the preferred embodiment, the placement and arrangement of the ridges 16 and the grooves 26 on the forming surfaces of the dies is designed to provide the clamshell container of FIG. 5, but would be placed and arranged differently for other container configurations. As illustrated in FIG. 1, a first pair of spaced ridges 16*a* and 16*b* extend diagonally, in a V shape, across a sidewall 15 of the die, while a corresponding, second pair of spaced ridges (not visible) extend diagonally, in a V shape, across the opposite sidewall of the die. Each pair of ridges intersect at a central apex 16*c* near a base of the die. The first and second pairs of spaced ridges are linked respectively by a third pair of spaced ridges 16*d* and 16*e* extending transversely across the central segment of the die.

The placement of the grooves 26 illustrated in FIG. 1, mirrors that of the ridges 16 in the male die 12. Therefore, a first pair of spaced grooves 26*a* and 26*b* extend diagonally, in a V shape, across a sidewall 25 of the die and a second pair of spaced grooves (not visible) extend in a similar manner across an opposite sidewall of the die. The central apex 26*c* of the each pair of spaced grooves is near an upper rim 23 of the die. A third pair of spaced grooves 26*d* and 26*e* link the first and second pairs transversely across the central segment of the die.

Figure 4:
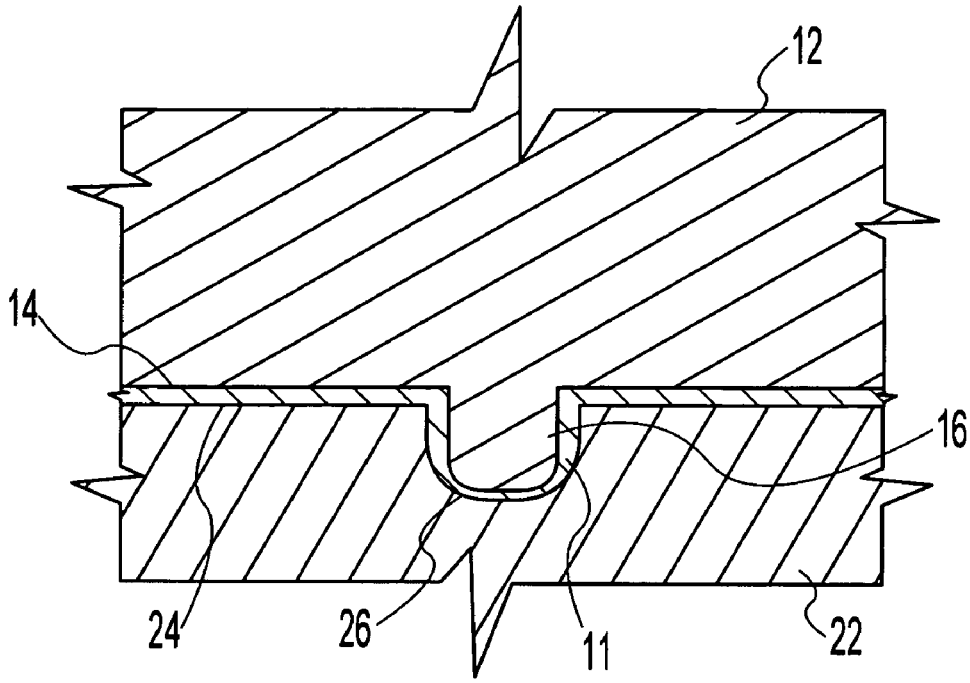
FIG. 4 is a cross-sectional side view of a segment of the embodiment of FIG. 1 illustrating the preferred ridge height in comparison to the groove depth.

Because of the opposing, mirrored placement of the grooves 26 and the ridges 16, the grooves 26 register with the ridges 16 when the dies matingly engage one another. As illustrated in FIG. 4, the top edges or crests of the ridges preferably extend above the forming surface of the male die 12 by a distance that is greater than the depth of the groove within the forming surface of the female die 22. This is desirable to create the proper crease in the paperboard sheet 11. When the forming surfaces 14 and 24 of the dies come together, the paperboard sheet 11 spaces the forming surfaces a distance that is the thickness of the paperboard. Because the ridges 16 extend from their adjoining forming surfaces a distance greater than the depth of the grooves 26 in their adjacent forming surfaces, when the paperboard sheet 11 is pressed into an indentation the paperboard is crushed at the ridge. This creates an area of weakness for folding, in addition to deforming the paperboard sheet 11 into a semi-circular gutter. The feature of having the height of the ridges greater than the depth of the grooves is particularly preferred when pressforming solid paperboard instead of corrugated paperboard.

Figure 6:
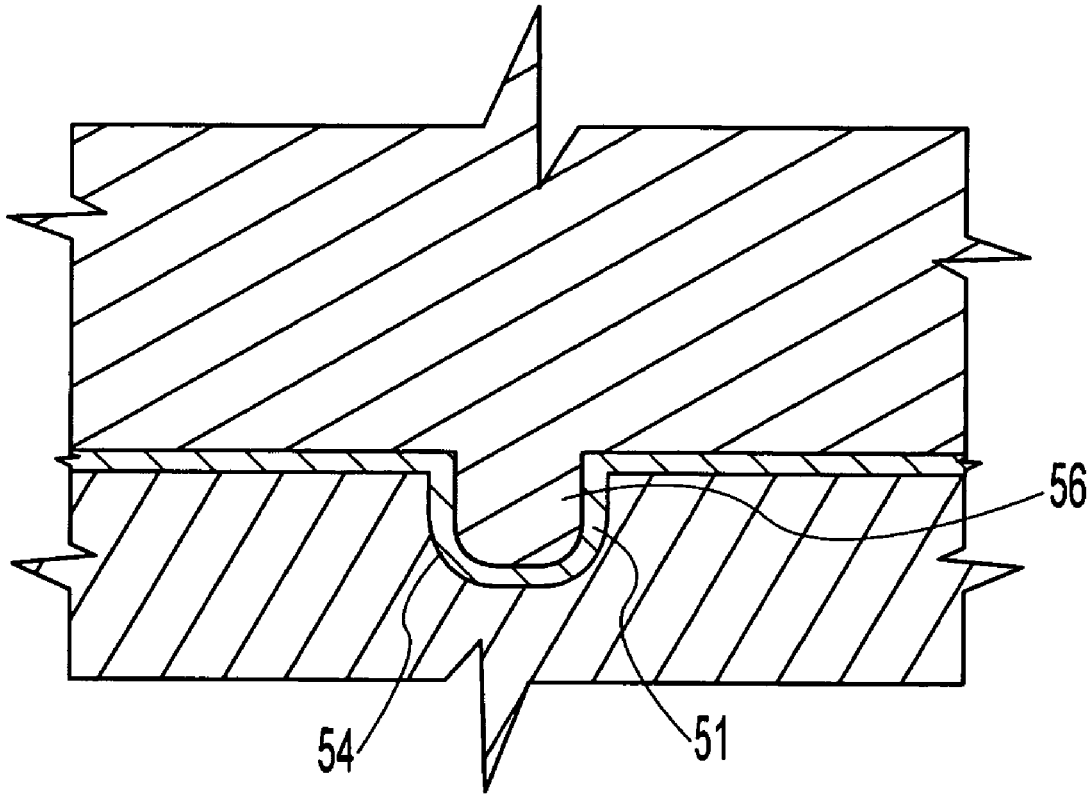
FIG. 6 is a cross-sectional side view similar to FIG. 4 and illustrating an alternative embodiment of the invention.

Alternatively, FIG. 6 illustrates that the ridges 56 can extend from the die by a distance that is substantially the same as the depth of the grooves 54, so that only a change in contour of the paperboard sheet 51 will occur at the crease. In this case, the paperboard will bend into a channel that forms a hinge, but will have approximately the same thickness throughout the channel so it will not be as weakened. Even if the height of the ridges is the same as the depth of the grooves, if corrugated paperboard is pressformed, some thickness variation may occur, depending upon the nature of the corrugated paperboard, the pressure applied and the dimensions of the ridges and grooves. Specifically, if sufficient pressure is applied to crush the paperboard and make it slightly thinner, the paperboard between the sidewalls of the grooves and the sidewalls of the ridges will not be as crushed as the remaining portions of the paperboard because those sidewalls move generally parallel to each other. Therefore, the center of the channel formed in the paperboard can be thinner than the sidewalls of the channel.

The height and width of the ridges 16 and grooves 26 is dependent upon the type of paperboard material being used, including its thickness and whether it is corrugated or solid, and the type of score desired. For most practical embodiments, the ridges 16 can extend from the forming surface a height ranging from 0.015 inches to 0.030 inches and range in width from 0.028 inches to 0.042 inches wide. The grooves can range in depth from 0.010 inches to 0.060 inches and range in width from 0.060 inches to 0.125 inches wide. For example, in a preferred embodiment, the ridges have a height of 0.018 inches and a width of 0.028 inches. For those ridges, the groove depth can range from 0.012 inches to 0.016 inches, depending upon the thickness of the paperboard material being scored.

As illustrated in FIG. 1, the male die 12 has a draw ring 13 that follows the contour of the male die, but that moves independently of the die during operation. The draw ring 13 moves vertically along the sidewalls of the male die 12 to engage an interposed paperboard sheet, which in operation is between the horizontal planer outer rim 23 of the female die and the forming surface 14 of the male die. The draw ring 13 is typically moved downwardly by an actuator such as an air cylinder and applies pressure on the paperboard sheet 11 to keep the paperboard sheet from forming creases and folds in a diverse or random manner during pressforming. The draw ring 13 not only holds the paperboard sheet in place during pressforming, but also forms the rim 32 of the clamshell container 30. It is essential to keep the paperboard sheet 11 taut during pressforming in order to create uniform creases along the rim 32 of the container so that the top and bottom portions of the container will close properly.

The method used to simultaneously shape the container and form fold creases in the container uses the ridges 16 and the grooves 26 previously discussed. In the preferred embodiment, the paperboard sheet is placed horizontally between the male 12 and female 22 die set. As the forming surface 14 of the male die 12 moves in a direction toward the forming surface 24 of the female die 22, the draw ring 13 makes contact with the paperboard sheet and forces it against the upper rim 23 of the female die 22 to frictionally engage the sheet in between. The pressure is sufficient to provide a frictional force which resists yet allows sliding of the sheet inwardly as the dies engage. As the male die 12 descends further, the paperboard sheet slides in a horizontal direction along the upper rim 23 and is drawn down into the female cavity.

As the forming surfaces of the male 12 and female 22 dies engage, the ridges 16 and grooves 26 come into registration and the paperboard sheet is pressed between the ridges 16 and the grooves 26 to form fold creases.

Figure 2:
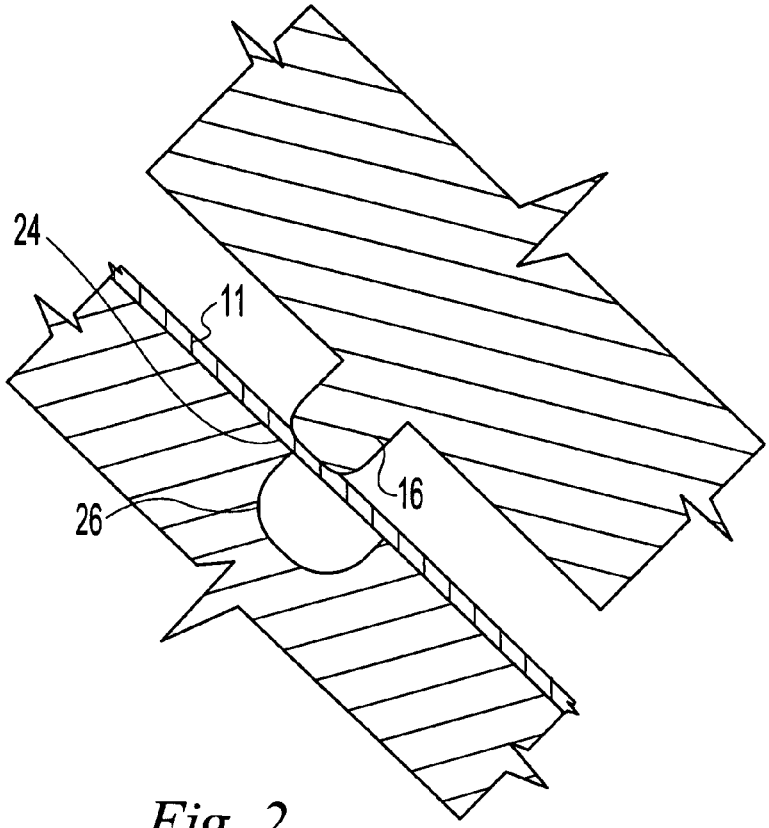
FIG. 2 is a cross-sectional side view of a segment of dies illustrating a possible interference between the ridge and the groove of dies similar to the embodiment of FIG. 1.

In the preferred embodiment, there are two pairs of ridges and grooves extending from or within the sidewalls of the dies and consequently the ridges 16 and grooves 26 are oriented at an oblique angle to the downward movement of the die during operation. When the male die 12 moves downwardly toward the female die 22, the ridges 16 also move downwardly toward the grooves 26. As the male die 12 is dynamically closing, if the ridges get too close to the forming surface 24 before entering the grooves, compression of the paperboard sheet 11 will prematurely begin between the ridges and a part of the forming surface causing an interference. As illustrated in FIG. 2, the paperboard sheet becomes pinched between the ridge 16 and the forming surface 24 adjacent to the groove which can cut or drag and tear the paperboard sheet 11. Additionally, if the ridges 16 instead of making contact with the forming surface 24, nearly makes contact with the forming surface it is possible that both the edge of the forming surface and the ridges would pinch the paperboard and form a displaced crease or weakness in the paperboard sheet 11. This displaced creases can prevent the formed container from folding properly resulting in a deformed clam shell container that is unsuitable for use.

Figure 3:
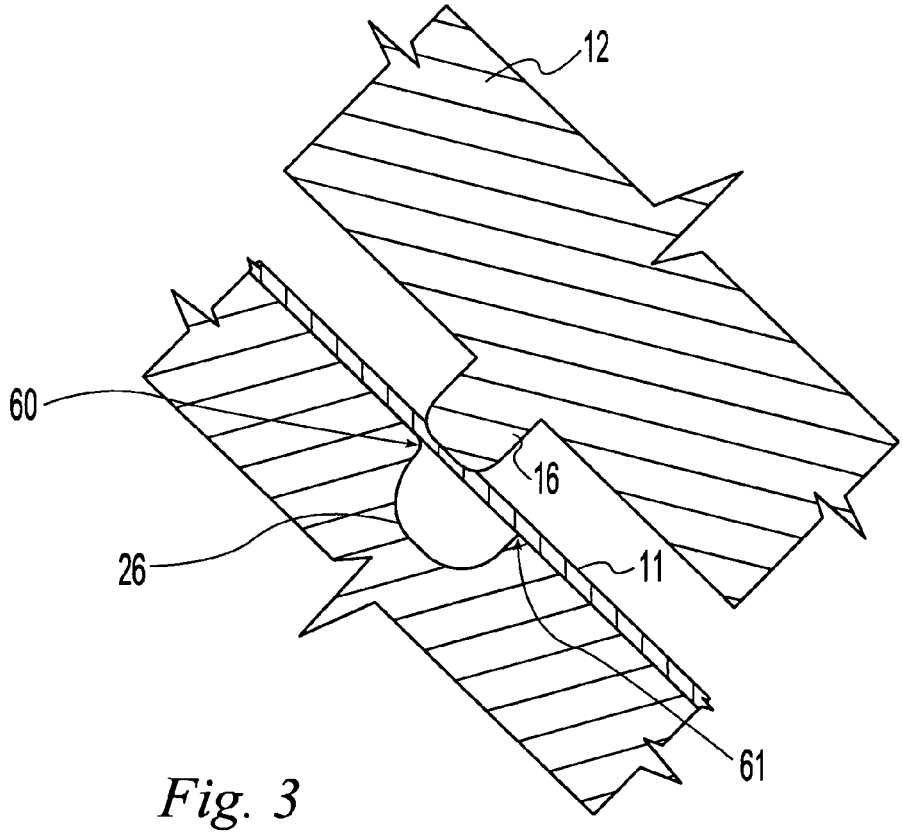
FIG. 3 is a cross-sectional side view similar to FIG. 2 and illustrating the preferred ridge and groove interaction of the embodiment of FIG. 1 which avoids the interference.

To overcome the potential problems of interference between the oblique ridge on one die and the forming surface of the other die, several options are available. Referring to FIG. 3 and the preferred embodiment, the grooves are bounded by an innermost edge 61 and an outermost and uppermost edge 60, which is interfering in FIG. 3 with the ridge 16. However, as illustrated in FIG. 3, the outermost edge 60 can be made recessed an amount sufficient to avoid interference with the ridges 16 of the male die 12 when the dies are moved into mating engagement on opposite sides of the paperboard sheet 11. Thus, the grooves can be formed within the forming surface 24 so the grooves are lopsided or widened by removing a portion of the steel from the uppermost edge 60 of the groove 26. The grooves can be made wider by alternately testing the engaging dies for interference and removing a portion of the forming surface 24 in small increments between tests until the interference is eliminated. The exact clearances can be determined through empirical testing or by using computer-aided drafting (CAD) design.

Since horizontal die surfaces with mating ridges and grooves come into registration without any interference problem as illustrated in FIGS. 4 and 6, alternatively, the die can be formed having a more nearly horizontal sidewall so that the interference problem is reduced because there is a range of angular inclination to horizontal which will also not present an interference problem.

Figure 7:
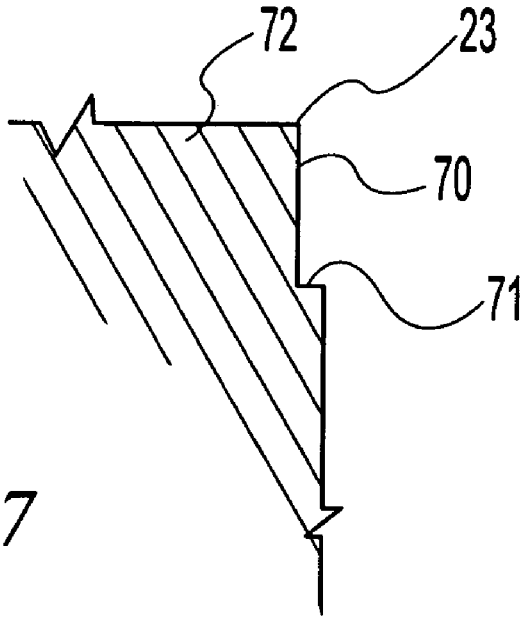
FIG. 7 is a cross-sectional side view illustrating an alternative embodiment of the invention.

In another alternative and referring to FIG. 7, the groove can be a recess 71 extending all the way to the top rim 23 of the female die. This forms a shoulder 70. Here, the interference is overcome by having a groove with a completely vertical sidewall, wherein the sidewall has enough material removed so it does not interfere with the downward movement of the ridge (not shown). Pressing the ridge and the paperboard sheet against the innermost edge of the groove 71 forms the desired crease in the paperboard sheet.

In a third alternative (not illustrated), the male die can be separated into three independent components, two independent lobes and an independent central segment. In this alternative, the two pressforming lobes can move the paperboard sheet downwardly into the cavity of the female die forming the container. The central segment containing the ridges will follow shortly thereafter to form the creases in the paperboard sheet and finish the pressforming process. This may help to overcome the interference between the movement of the paperboard sheet and the angled ridges and grooves.

In a fourth alternative (also not illustrated), the ridges of the die can be retractable. In this alternative, the ridges are housed within pre-cut slots of the forming surface and are only extended to engage the paperboard sheet after the male die has completely engaged the paperboard sheet within the female cavity. Here, the male die moves into mating engagement with the female cavity allowing the grooves and the openings for the ridges to come into registration on opposite sides of the paperboard sheet. Once the dies are in registration, the ridges are extended to engage the paperboard sheet thereby forming the semi-circular gutter or crease in the paperboard sheet.

As discussed above, it is difficult to both form fold creases and pressform a clamshell container using conventional methods. The traditional two step forming process makes it difficult for the score lines to survive pressforming. The preferred apparatus and method for pressforming a clamshell container are advantageous over previous pressforming methods because as the paperboard is pressformed between the male and female dies to form the container shape, the ridges and grooves are simultaneously forming the fold creases in the paperboard sheet 11. The container is pressformed and the fold creases are formed in one step eliminating the problem of the score lines disappearing during pressforming.

While certain preferred embodiments of the present invention have been disclosed in detail, it is to be understood that various modifications may be adopted without departing from the spirit of the invention or scope of the following claims.

The invention claimed is:

1. An apparatus for pressforming a paperboard sheet into an articulable pressformed container, the apparatus comprising: a pair of male and female, matingly engagable dies having interfacing forming surfaces in the shape of a container for engaging the paperboard sheet, at least a first one of said dies having a plurality of ridges extending from the forming surface and the second of said dies having a plurality of grooves within the forming surface, the grooves registering with the ridges when the dies matingly engage for forming fold creases in the paperboard sheet, wherein the mating forming surfaces of the dies are oriented obliquely to an intended direction of movement toward each other and wherein at least one of the grooves of the second die is bounded, in an operable position of the dies, by an outermost edge closer to the first die and an innermost edge further from the first die, the outermost edge being recessed an amount sufficient to avoid interference with the ridge of the first die when the dies are moved into mating engagement on opposite sides of the paperboard sheet.

2. An apparatus for pressforming a paperboard sheet into an articulable pressformed container, the apparatus comprising: a pair of male and female, matingly engagable dies having interfacing forming surfaces in the shape of a container for engaging the paperboard sheet, at least a first one of said dies having a plurality of ridges extending from the forming surface and the second of said dies having a plurality of grooves within the forming surface, the grooves registering with the ridges when the dies matingly engage for forming fold creases in the paperboard sheet, wherein each of said dies has two rounded lobes with a central narrower segment connecting the two lobes, the first die being a punch and the second die being a cavity for accepting the punch of the first die, wherein a first pair of spaced ridges extend diagonally, in a V shape, across a sidewall of the first die and a second pair of spaced ridges extend diagonally, in a V shape, across an opposite sidewall of the die, each having a central apex near a base of the die, the first and second pair of spaced ridges linked by a third pair of spaced ridges transversely across the central segment of the first die.

3. An apparatus in accordance with claim 2, wherein a first pair of spaced grooves extend diagonally, in a V shape, across a sidewall of the second die and a second pair of spaced grooves extend diagonally, in a V shape, across an opposite sidewall of the die, each having a central apex near an upper rim of the die, the first and second pair of spaced grooves linked by a third pair of spaced grooves transversely across the central segment of the second die.

4. An apparatus for pressforming a paperboard sheet into an articulable pressformed container, the apparatus comprising: a pair of male and female, matingly engagable dies having interfacing forming surfaces in the shape of a container for engaging the paperboard sheet, at least a first one of said dies having a plurality of ridges extending from the forming surface and the second of said dies having a plurality of grooves within the forming surface, the grooves registering with the ridges when the dies matingly engage for forming fold creases in the paperboard sheet, wherein each of said dies has two rounded lobes with a central narrower segment connecting the two lobes, the first die being a punch and the second die being a cavity for accepting the punch of the first die, wherein the ridges extend from the male die and the grooves are within the female die.

5. An apparatus for pressforming a paperboard sheet into an articulable pressformed container, the apparatus comprising: a pair of male and female, matingly engagable dies having interfacing forming surfaces in the shape of a container for engaging the paperboard sheet, at least a first one of said dies having a plurality of ridges extending from the forming surface and the second of said dies having a plurality of grooves within the forming surface, the grooves registering with the ridges when the dies matingly engage for forming fold creases in the paperboard sheet, wherein the mating forming surfaces of the dies are oriented obliquely to an intended direction of movement toward each other and wherein at least one of the grooves of the second die is bounded, in an operable position of the dies, by an outermost edge closer to the first die and an innermost edge further from the first die, the outermost edge being recessed to a point near a top edge of the second die to form a shoulder and avoid interference with the ridge of the first die when the dies are moved into mating engagement on opposite sides of the paperboard sheet.

* * * * *